US011691849B2

(12) United States Patent
Bae

(10) Patent No.: US 11,691,849 B2
(45) Date of Patent: Jul. 4, 2023

(54) ELEVATOR SAFETY DEVICE

(71) Applicant: HUMAN NT CO., LTD., Gyeonggi-do (KR)

(72) Inventor: Hoo Geun Bae, Incheon (KR)

(73) Assignee: HUMAN NT CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/277,564

(22) PCT Filed: Sep. 17, 2019

(86) PCT No.: PCT/KR2019/011988
§ 371 (c)(1),
(2) Date: Mar. 18, 2021

(87) PCT Pub. No.: WO2020/060149
PCT Pub. Date: Mar. 26, 2020

(65) Prior Publication Data

US 2021/0354956 A1 Nov. 18, 2021

(30) Foreign Application Priority Data

Sep. 19, 2018 (KR) ..... 10-2018-0111956

(51) Int. Cl.
*B66B 5/22* (2006.01)

(52) U.S. Cl.
CPC ..... *B66B 5/22* (2013.01)

(58) Field of Classification Search
CPC ..... B66B 5/22; B66B 11/0206
See application file for complete search history.

(56) References Cited

FOREIGN PATENT DOCUMENTS

| | | | | |
|---|---|---|---|---|
| KR | 200386599 | | 6/2005 | |
| KR | 20170062653 | | 6/2017 | |
| WO | WO-2006026873 | A1 * | 3/2006 | ..... B66B 11/0206 |
| WO | WO2013035175 | | 3/2013 | |
| WO | WO-2013035175 | A1 * | 3/2013 | ..... B66B 5/18 |

OTHER PUBLICATIONS

Machine Translation of WO 2006026873.*

* cited by examiner

*Primary Examiner* — Diem M Tran
(74) *Attorney, Agent, or Firm* — IPLA P.A.

(57) ABSTRACT

An elevator safety device includes: a lower beam; and an emergency stop device mounted parallel to the lower beam in order to perform an emergency stop of an elevator car, wherein the lower beam includes: a first side member; a second side member disposed opposite the first side member; a front support member configured to be coupled to and to support front portions of the first side member and the second side member; and a rear support member configured to be coupled to and to support rear portions of the first side member and the second side member.

2 Claims, 6 Drawing Sheets

ELEVATOR SAFETY DEVICE

BACKGROUND

The present invention relates to an elevator, and more particularly to an elevator safety device in which a front support member and a rear support member are respectively coupled to the front portions and the rear portions of a first side member and a second side member, thereby preventing damage to the front and rear portions of the respective side members and increasing the strength thereof.

In general, an elevator is an apparatus installed in a building to convey persons or goods to desired positions, and is configured such that an elevator car, connected to a main rope, ascends or descends along a guide rail in a hoistway formed vertically in a building.

The elevator is composed of a car frame assembly, supporting the elevator car, and other parts, and the car frame assembly is referred to as a car beam. The car beam is structured such that an upper beam, side beams, and a lower beam are integrally formed through welding, such that a rope connection member and a suspension sheave are mounted to the upper beam, and such that a metallic member and a guide shoe, which support the bottom of the elevator car and on which an emergency stop device, a traveling cable, and a compensating rope are hung, are mounted to the lower beam.

As a conventional art of the lower beam, an elevator-beam-coupling structure is disclosed in Korean Patent Laid-Open Publication No. 10-2017-0062653.

The disclosed patent is configured such that a lower beam, in which a pair of members is connected via a middle reinforcing member, is connected to side beams via connection beams, but has a problem in that the lower beam is deformed due to torsion caused by the middle reinforcing member connected to the lower end portions of the pair of members.

Further, the pair of members is not connected until the open front and rear portions of the lower beam are connected to the side beams via the connection beams, so there are problems in that the lower beam is not smoothly coupled to the side beams due to damage caused by external force and in that the strength thereof is decreased.

Patent Document 1: Korean Patent Laid-Open Publication No. 10-2017-0062653

SUMMARY OF THE INVENTION

Therefore, the present invention has been made to solve the above problems, and it is an object of the present invention to provide an elevator safety device in which a front support member and a rear support member are respectively coupled to the front portions and the rear portions of a first side member and a second side member, thereby preventing damage to the front and rear portions of the respective side members.

In addition, it is an object of the present invention to provide an elevator safety device in which a front support member and a rear support member are respectively coupled to the front portions and the rear portions of a first side member and a second side member, thereby increasing the strength of the front and rear portions of the respective side members.

In addition, it is an object of the present invention to provide an elevator safety device in which pads of a first emergency stop unit and a second emergency stop unit, which are respectively mounted to the front and rear portions of a first side member and a second side member, are simultaneously moved upwards by rotation of a hinge member and are brought into close contact with a guide rail, thereby performing an emergency stop of an elevator car.

Technical Solution

An elevator safety device according to the present invention includes a lower beam and an emergency stop device mounted parallel to the lower beam in order to perform an emergency stop of an elevator car. The lower beam includes a first side member, a second side member disposed opposite the first side member, a front support member configured to be coupled to and to support the front portions of the first side member and the second side member, and a rear support member configured to be coupled to and to support the rear portions of the first side member and the second side member.

In the elevator safety device according to the present invention, the first side member includes a first vertical surface having a rectangular plate shape, a first upper surface and a first lower surface bent and extending from the upper and lower end portions of the first vertical surface in a direction away from the second side member, a first front surface extending from the front portion of the first vertical surface, and a first rear surface extending from the rear portion of the first vertical surface.

In the elevator safety device according to the present invention, the second side member includes a second vertical surface having a rectangular plate shape, a second upper surface and a second lower surface bent and extending from the upper and lower end portions of the second vertical surface in a direction away from the first side member, a second front surface extending from the front portion of the second vertical surface, and a second rear surface extending from the rear portion of the second vertical surface.

In the elevator safety device according to the present invention, the front support member and the rear support member include bodies formed so as to surround the front and rear portions of the first side member and the second side member, slits formed through the bodies in order to allow the first front surface of the first side member, the second front surface of the second side member, the first rear surface of the first side member, and the second rear surface of the second side member to be fitted thereinto and to protrude therefrom, and operation holes formed through the bodies in order to guide ascent and descent of a rotary control piece of the emergency stop device.

In the elevator safety device according to the present invention, the bodies include vertical surfaces through which the slits and the operation holes are formed, upper surfaces bent and extending from the upper end portions of the vertical surfaces so as to be seated on a first upper surface of the first side member and a second upper surface of the second side member, and lower surfaces bent and extending from the lower end portions of the vertical surfaces so as to be seated on a first lower surface of the first side member and a second lower surface of the second side member.

In the elevator safety device according to the present invention, the upper surfaces are formed to be shorter than the lower surfaces.

In the elevator safety device according to the present invention, a connection-reinforcing member, which connects the first side member and the second side member to each other to reinforce the same, is further included.

In the elevator safety device according to the present invention, the connection-reinforcing member is mounted to the upper surfaces of the first side member and the second side member to reinforce the same.

In the elevator safety device according to the present invention, the connection-reinforcing member is mounted to the lower surfaces of the first side member and the second side member to reinforce the same.

In the elevator safety device according to the present invention, the emergency stop device includes a hinge member, a first emergency stop unit configured to be rotated upwards in a front region of the first side member and the second side member by rotation of the hinge member in order to cause a first pad to come into close contact with a guide rail so that downward movement of the elevator car is stopped, and a second emergency stop unit configured to be rotated upwards in a rear region of the first side member and the second side member by movement of a link member due to rotation of the hinge member in order to cause a second pad to come into close contact with the guide rail so that downward movement of the elevator car is stopped.

An elevator safety device according to the present invention includes a lower beam and an emergency stop device mounted parallel to the lower beam in order to perform an emergency stop of an elevator car. The lower beam includes a first side member, a second side member disposed opposite the first side member, a front support member configured to be coupled to and to support the front portions of the first side member and the second side member, and a rear support member configured to be coupled to and to support the rear portions of the first side member and the second side member. The front support member and the rear support member include bodies formed so as to surround the front and rear portions of the first side member and the second side member, slits formed through the bodies in order to allow a first front surface of the first side member, a second front surface of the second side member, a first rear surface of the first side member, and a second rear surface of the second side member to be fitted thereinto and to protrude therefrom, and operation holes formed through the bodies in order to guide ascent and descent of a rotary control piece of the emergency stop device.

According to the present invention, the front support member and the rear support member are respectively coupled to the front portions and the rear portions of the first side member and the second side member, so there is an effect of facilitating construction while preventing damage to the front and rear portions of the respective side members.

In addition, according to the present invention, the front support member and the rear support member are respectively coupled to the front portions and the rear portions of the first side member and the second side member, so there is an effect of increasing the lifespan of the product due to the increased strength of the front and rear portions of the respective side members and of facilitating maintenance and repair due to an extended replacement cycle of parts.

In addition, according to the present invention, the pads of the first emergency stop unit and the second emergency stop unit, which are respectively mounted to the front and rear portions of the first side member and the second side member, are simultaneously moved upwards by rotation of the hinge member and are brought into close contact with the guide rail, thereby performing an emergency stop of the elevator car while preventing the elevator car from becoming unbalanced, thus ensuring the safety of passengers.

DETAILED DESCRIPTION OF THE INVENTION

Hereinafter, embodiments of the present invention will be described in detail with reference to the accompanying drawings so that those skilled in the art to which the present invention pertains may easily carry out the embodiments. The present invention may, however, be embodied in many different forms, and should not be construed as being limited to the embodiments set forth herein.

Figure 1:
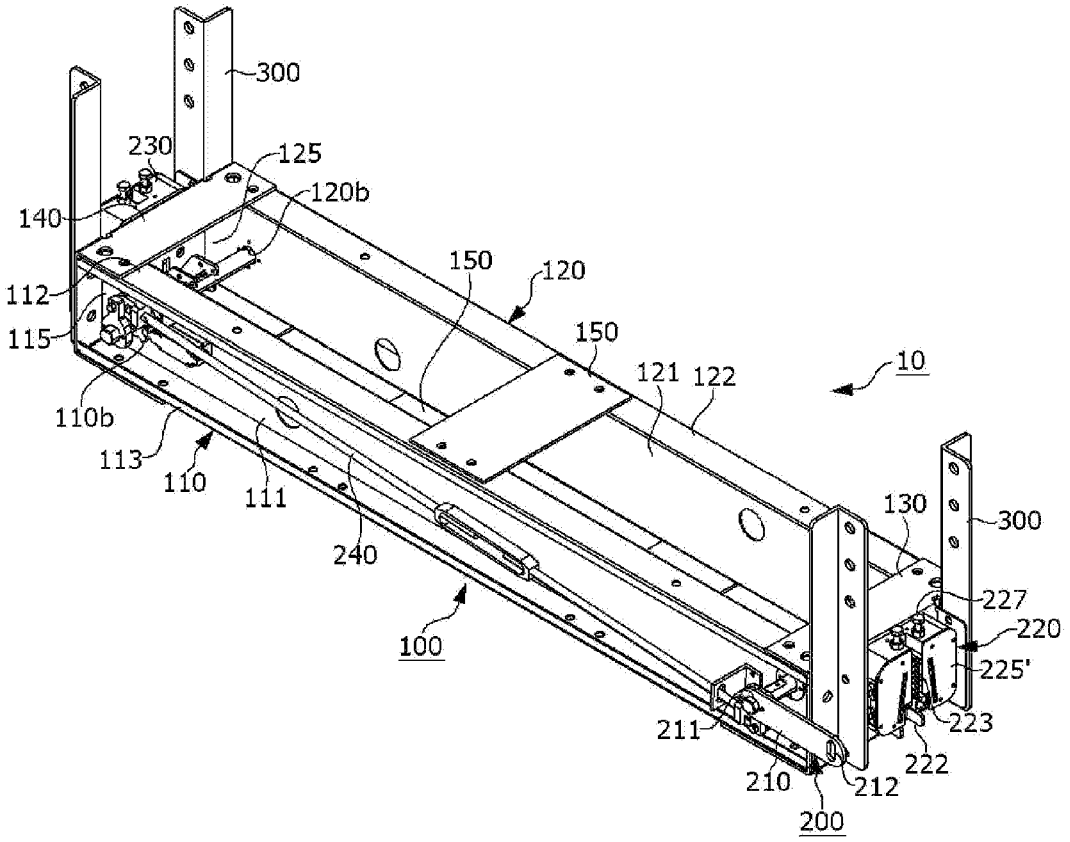
FIG. 1 is a perspective view of an elevator safety device to which the present invention is applied.
Figure 2:
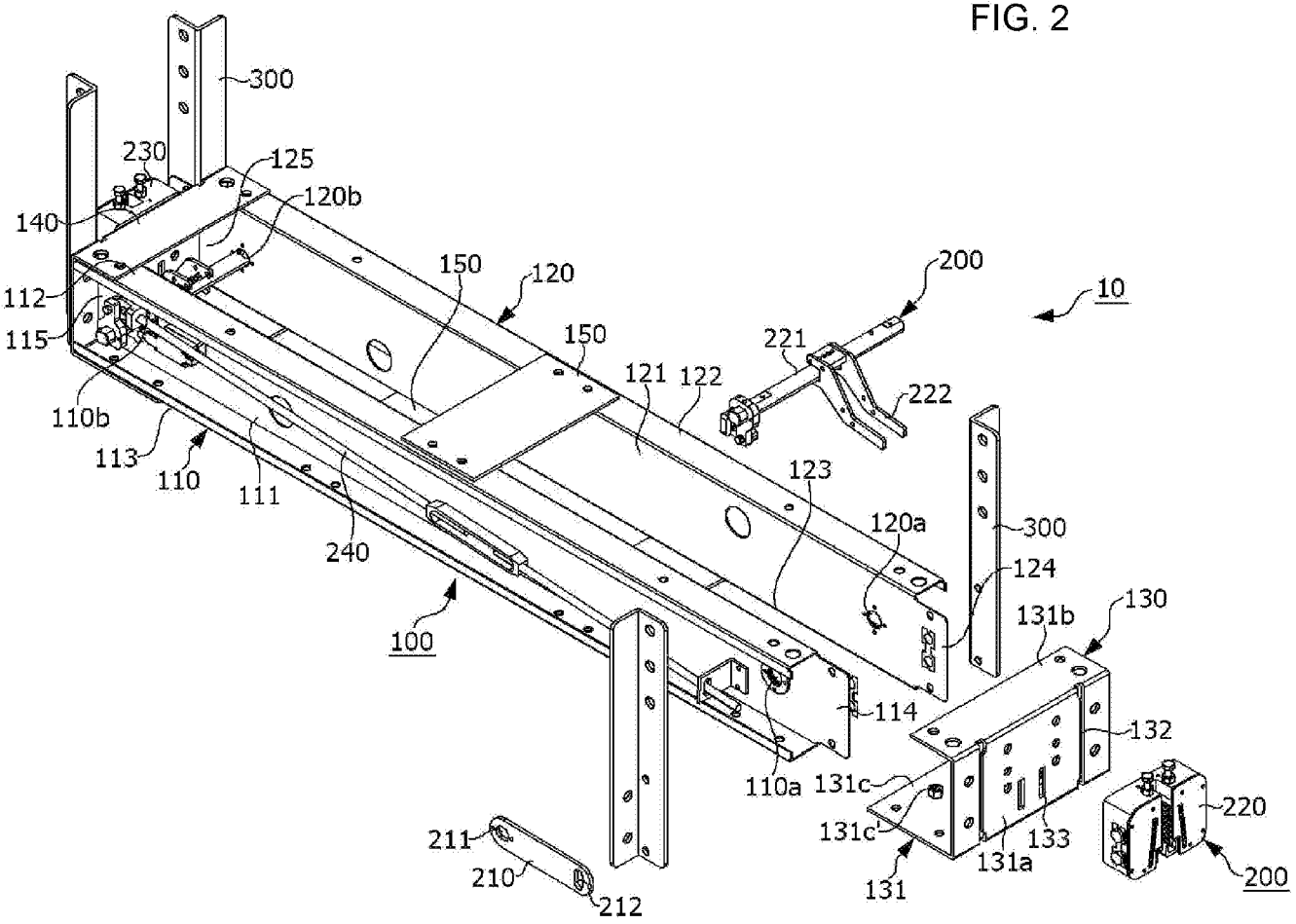
FIG. 2 is a front exploded perspective view of the elevator safety device to which the present invention is applied.
Figure 3:
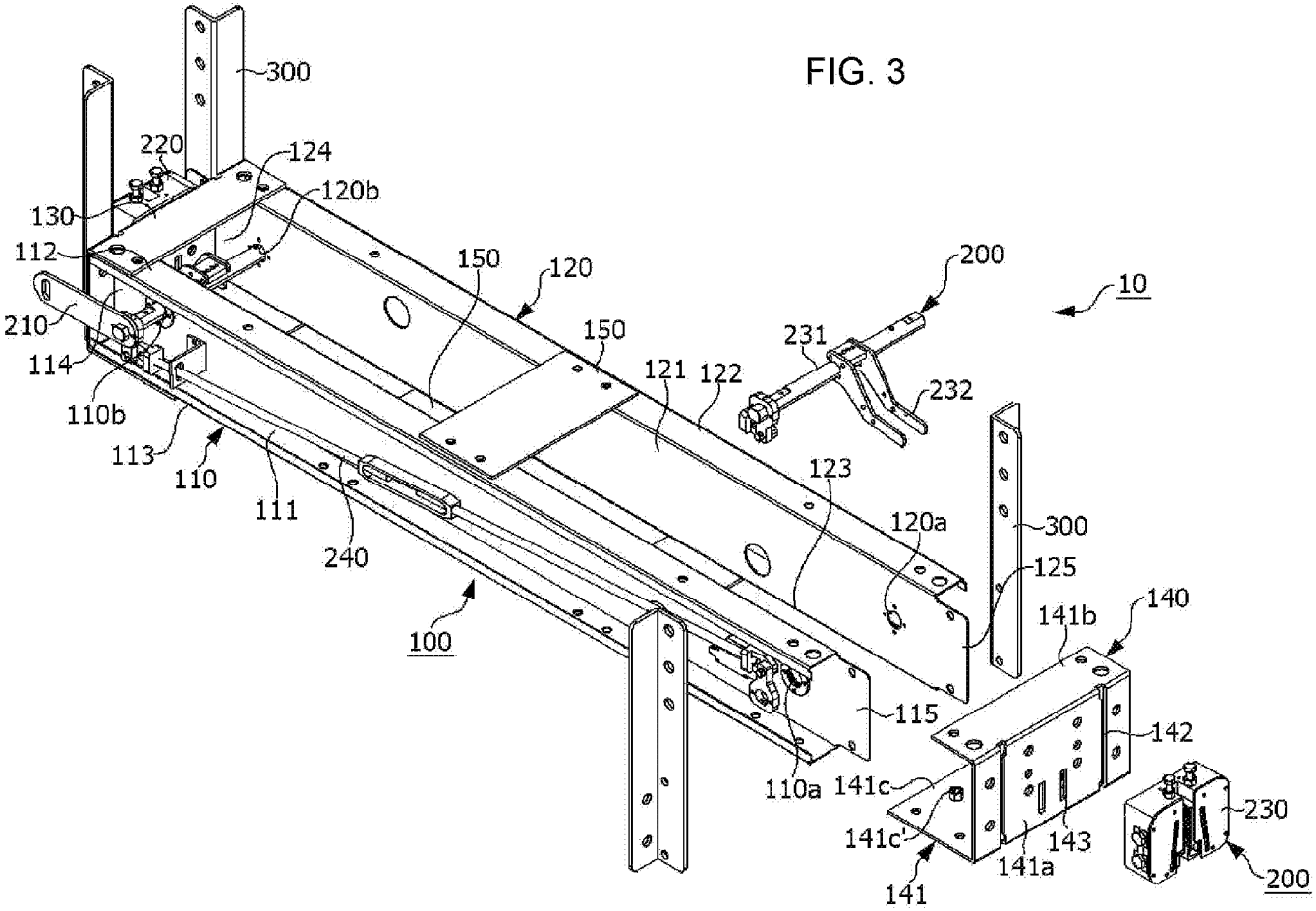
FIG. 3 is a rear exploded perspective view of the elevator safety device to which the present invention is applied.

FIG. 1 is a perspective view of an elevator safety device to which the present invention is applied, FIG. 2 is a front exploded perspective view of the elevator safety device to which the present invention is applied, and FIG. 3 is a rear exploded perspective view of the elevator safety device to which the present invention is applied.

The elevator safety device 10 according to the present invention is configured to support an elevator car 30 and to stop downward movement of the elevator car 30 when the elevator car 30 descends at a speed exceeding a threshold speed, and includes a lower beam 100 and an emergency stop device 200.

The lower beam 100 is configured to support the elevator car 30, and includes a first side member 110, a second side member 120, a front support member 130, and a rear support member 140.

The first side member 110 is configured to support the elevator car 30 together with the second side member 120, and includes a first vertical surface 111, a first upper surface 112, a first lower surface 113, a first front surface 114, and a first rear surface 115.

The first vertical surface 111 is formed in a rectangular plate shape, and has the same length as the width of the bottom surface of the elevator car 30.

The first upper surface 112 is bent and extends a predetermined length from the upper end portion of the first vertical surface 111 in a direction away from the second side member 120.

The first lower surface 113 is bent and extends a predetermined length from the lower end portion of the first vertical surface 111 in a direction away from the second side member 120.

The first front surface 114 extends a predetermined length from the front portion of the first vertical surface 111.

The first rear surface 115 extends a predetermined length from the rear portion of the first vertical surface 111.

The second side member 120 is configured to support the elevator car 30 together with the first side member 110, and includes a second vertical surface 121, a second upper surface 122, a second lower surface 123, a second front surface 124, and a second rear surface 125.

The second vertical surface 121 is formed in a rectangular plate shape, and has the same length as the width of the bottom surface of the elevator car 30.

The second upper surface 122 is bent and extends a predetermined length from the upper end portion of the second vertical surface 121 in a direction away from the first side member 110.

The second lower surface 123 is bent and extends a predetermined length from the lower end portion of the second vertical surface 121 in a direction away from the first side member 110.

The second front surface 124 extends a predetermined length from the front portion of the second vertical surface 121.

The second rear surface 125 extends a predetermined length from the rear portion of the second vertical surface 121.

The front support member 130 and the rear support member 140 are configured to be coupled to the front portions and the rear portions of the first side member 110 and the second side member 120, and include bodies 131 and 141, slits 132 and 142, and operation holes 133 and 143.

The bodies 131 and 141 include vertical surfaces 131*a* and 141*a*, upper surfaces 131*b* and 141*b*, and lower surfaces 131*c* and 141*c*.

The vertical surfaces 131*a* and 141*a* are formed in a plate shape, and the slits 132 and 142 and the operation holes 133 and 143 are formed so as to penetrate the vertical surfaces 131*a* and 141*a*.

The upper surfaces 131*b* and 141*b* are bent and extend from the upper end portions of the vertical surfaces 131*a* and 141*a*, and are seated on the first upper surface 112 of the first side member 110 and the second upper surface 122 of the second side member 120.

The lower surfaces 131*c* and 141*c* are bent and extend from the lower end portions of the vertical surfaces 131*a* and 141*a*, and are seated on the first lower surface 113 of the first side member 110 and the second lower surface 123 of the second side member 120.

Here, the upper surfaces 131*b* and 141*b* and the lower surfaces 131*c* and 141*c* may be formed so as to be the same width; however, the upper surfaces 131*b* and 141*b* may be formed to be larger than the lower surfaces 131*c* and 141*c* or vice versa in order to increase the support area thereof.

In addition, a connection-reinforcing member 150, which connects the first side member 110 and the second side member 120 to each other to reinforce the same, may be further included.

The connection-reinforcing member 150 may be plural in number in order to connect the first upper surface 112 of the first side member 110 and the second upper surface 122 of the second side member 120 to each other at multiple positions and to connect the first lower surface 113 of the first side member 110 and the second lower surface 123 of the second side member 120 to each other at multiple positions.

Meanwhile, the emergency stop device 200 is configured to be mounted to the lower beam 100 in order to stop downward movement of the elevator car 30 when the elevator car 30 descends at a speed exceeding a threshold speed, and includes a hinge member 210, a first emergency stop unit 220, and a second emergency stop unit 230.

The hinge member 210 is formed in a plate shape, and has through-holes 211 and 212 formed so as to penetrate two opposite end portions thereof, and it is preferable for the through-hole 211, in which a first rotary member 221 of the first emergency stop unit 220 is fitted, to penetrate the hinge member in a polygonal shape.

Figure 4:
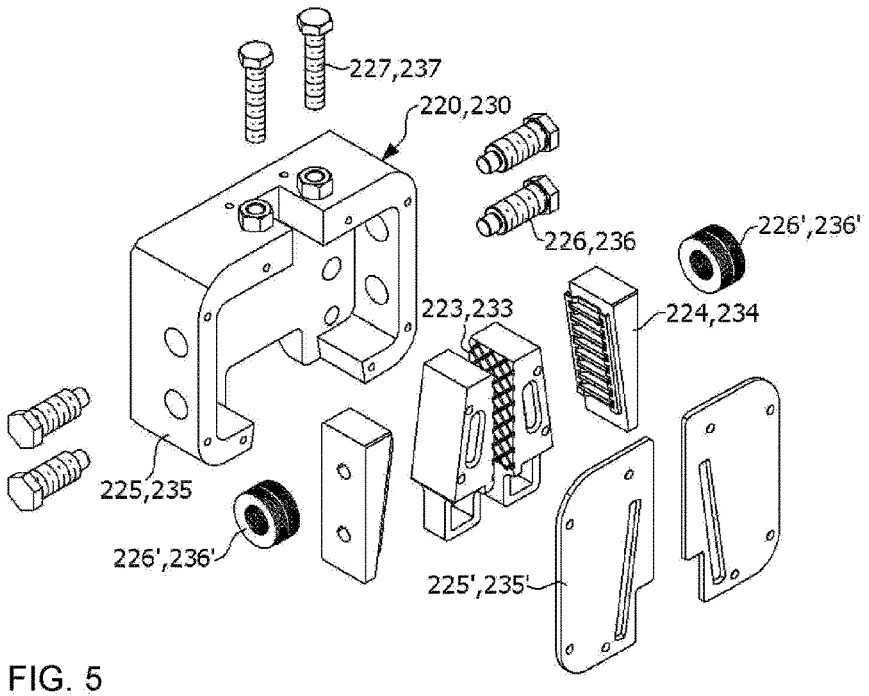
FIG. 4 is an exploded perspective view of first and second emergency stop units of the elevator safety device to which the present invention is applied.

As shown in FIG. 4, the first emergency stop unit 220 is configured to stop the downward movement of the elevator car 30 using the frictional force that is generated when the front portions of the first side member 110 and the second side member 120 are rotated upwards by the hinge member 210 so that a first pad 223 comes into close contact with a guide rail 20, and includes a first rotary member 221, a first rotary piece 222, a first pad 223, a first movement control member 224, and a first frame 225.

The first rotary member 221 is formed in a rod shape so as to be fitted into a front through-hole 110*a* in the first side member 110 and a front through-hole 120*a* in the second side member 120, and one end portion thereof is formed in a polygonal shape so that the hinge member 210 is coupled thereto and rotates together with the first rotary member.

Further, the middle portion of the first rotary member 221 is chamfered so that the first rotary piece 222 is coupled thereto and rotates together with the first rotary member 221.

The first rotary piece 222 is configured to be coupled to the first rotary member 221 so as to move the first pad 223 while being rotated by the first rotary member 221, and is coupled to the chamfered portion of the first rotary member 221.

The first pad 223 is coupled to the lower end portion of the first rotary piece 222, and ascends and descends due to the rotation of the first rotary piece 222.

The first movement control member 224 is configured to guide the first pad 223, which ascends, to move toward a side beam 40, and has an inclined surface that is in surface contact with the first pad 223.

The first frame 225 is configured to accommodate the first movement control member 224 and the first pad 223 and to be mounted to the front support member 130. The first frame 225 further includes a support bolt 226, which is fastened to the first frame 225 in order to press and support the first movement control member 224 accommodated in the first frame 225, and further includes a pad support bolt 227, which is fastened to the first frame 225 in order to control the upward movement of the first pad 223.

The second emergency stop unit 230 is configured to stop the downward movement of the elevator car 30 using the frictional force that is generated when the rear portions of the first side member 110 and the second side member 120 are rotated upwards by a link member 240, which is moved by rotation of the hinge member 210, so that a second pad 223 comes into close contact with the guide rail 20, and includes a second rotary member 231, a second rotary piece 232, a second pad 233, a second movement control member 234, and a second frame 235.

The second rotary member 231 is formed in a rod shape so as to be fitted into a rear through-hole 110*b* in the first side member 110 and a rear through-hole 120*b* in the second side member 120, and the link member 240 is coupled to one end portion thereof.

Further, the middle portion of the second rotary member 231 is chamfered so that the second rotary piece 232 is coupled thereto and rotates together with the second rotary member 231.

The second rotary piece 232 is configured to be coupled to the second rotary member 231 so as to move the second pad 233 while being rotated by the second rotary member 231, and is coupled to the chamfered portion of the second rotary member 231.

The second pad 233 is coupled to the lower end portion of the second rotary piece 232, and ascends and descends due to the rotation of the second rotary piece 232.

The second movement control member 234 is configured to guide the second pad 233, which ascends, to move toward the side beam 40, and has an inclined surface that is in surface contact with the second pad 233.

The second frame 235 is configured to accommodate the second movement control member 234 and the second pad 233 and to be mounted to the rear support member 140. The second frame 235 further includes a support bolt 236, which is fastened to the second frame 225 in order to press and support the second movement control member 234 accommodated in the second frame 235, and further includes a pad support bolt 237, which is fastened to the second frame 235 in order to control the upward movement of the second pad 233.

Next, the process of manufacturing the elevator safety device 10 according to the present invention configured as described above and the operation thereof will be described.

First, the first rotary piece 222 of the first emergency stop unit 220 is coupled to the chamfered portion of the first rotary member 221 and is fixed by a bolt (not shown) fastened thereto, and the two opposite end portions of the first rotary member 221 are fitted into the front through-hole 110*a* in the first side member 110 and the front through-hole 120*a* in the second side member 120. The second rotary piece 232 of the second emergency stop unit 230 is coupled to the chamfered portion of the second rotary member 231 and is fixed by a bolt (not shown) fastened thereto, and the two opposite end portions of the second rotary member 231 are fitted into the rear through-hole 110*b* in the first side member 110 and the rear through-hole 120*b* in the second side member 120.

After the first and second rotary members 221 and 231 are respectively fitted into the front and rear through-holes in the first and second side members 110 and 120, the front and rear support members 130 and 140 are respectively coupled to the first and second front surfaces 114 and 124 and the first and second rear surfaces 115 and 125 of the first and second side members 110 and 120.

At this time, the first and second front surfaces 114 and 124 and the first and second rear surfaces 115 and 125 are respectively fitted into the slits 132 and 142 formed through the vertical surfaces 131*a* and 141*a* of the bodies 131 and 141 of the front and rear support members 130 and 140 such that the first and second front surfaces 114 and 124 and the first and second rear surfaces 115 and 125 protrude outside the slits 132 and 142 and such that the first and second rotary pieces 222 and 232 protrude outside the operation holes 133 and 143. At the same time, the front and rear support members 130 and 140 move in the state in which the upper surfaces 131*b* and 141*b* and the lower surfaces 131*c* and 141*c*, which are bent and extend from the upper and lower end portions of the vertical surfaces 131*a* and 141*a* of the bodies 131 and 141, are in surface contact with the first and second upper surfaces 112 and 122 and the first and second lower surfaces 113 and 123 of the first and second side support members 110 and 120, and stop moving when the vertical surfaces 131*a* and 141*a* come into close contact with the first and second upper surfaces 112 and 122 and the first and second lower surfaces 113 and 123 of the first and second side support members 110 and 120.

When the vertical surfaces 131*a* and 141*a* come into close contact with the upper surfaces and the lower surfaces of the first and second side support members 110 and 120, through-holes (not shown) formed through the upper surfaces 131*b* and 141*b* and the lower surfaces 131*c* and 141*c* of the bodies 131 and 141 and through-holes (not shown) formed through the upper surfaces and the lower surfaces of the first and second side members 110 and 120 are aligned with each other, bolts are inserted into the through-holes, and nuts are fastened to the bolts, whereby the front and rear support members 130 and 140 are secured to the first and second side members 110 and 120.

In addition, the first and second movement control members 224 and 234 are secured to the inside of the first and second frames 225 and 235 using the support bolts 226 and 236 so as to be disposed in a bilaterally symmetrical arrangement on the vertical surfaces 131*a* and 141*a* of the bodies 131 and 141. Push prevention members 226' and 236' are mounted between the first and second movement control members 224 and 234 and the first and second frames 225 and 235 in order to prevent the first and second movement control members 224 and 234 from being pushed, and then the first and second frames 225 and 235 are tightly secured to the vertical surfaces 131*a* and 141*a* by fastening bolts (not shown) thereto.

At this time, the first and second rotary pieces 222 and 232 are located inside the first and second frames 225 and 235 through the open lower end portions of the first and second frames 225 and 235, and the first and second pads 223 and 233 are respectively coupled to the first and second rotary pieces 222 and 232 located inside the first and second frames 225 and 235. The first and second pads 223 and 233 come into surface contact with the first and second movement control members 224 and 234 such that the contact surface between the first and second pads 223 and 233 and the first and second movement control members 224 and 234 is inclined.

Here, the pad support bolts 227 and 237 are fastened to the first and second frames 225 and 235 in order to limit the height to which the first and second pads 223 and 233 ascend, and the first and second frames 225 and 235 are covered by cover members 225' and 235' in order to prevent separation of the first and second movement control members 224 and 234 and the first and second pads 223 and 233 therefrom.

After the first and second emergency stop units 220 and 230 are respectively mounted to the front and rear support members 130 and 140, connection beams 300 are secured to the two opposite sides of each of the vertical surfaces 131*a* and 141*a* of the bodies 131 and 141 by fastening bolts and nuts thereto, the first and second rotary members 221 and 231 of the first and second emergency stop units 220 and 230 are connected to each other via the link member 240, and an end portion of the first rotary member 221 is fitted into the through-hole 211 in the hinge member 210, thereby completing assembly of the elevator safety device 10 according to the present invention.

At this time, the inner surface of the through-hole 211 in the hinge member 210 and the outer surface of the first rotary member 221 are formed in a polygonal shape, whereby the first rotary member 221 is capable of being rotated by the rotation of the hinge member 210. The link member 240 may be embodied as a single member; however, it is preferable that two members be connected via a turnbuckle so as to be adjustable in length.

Figure 5:
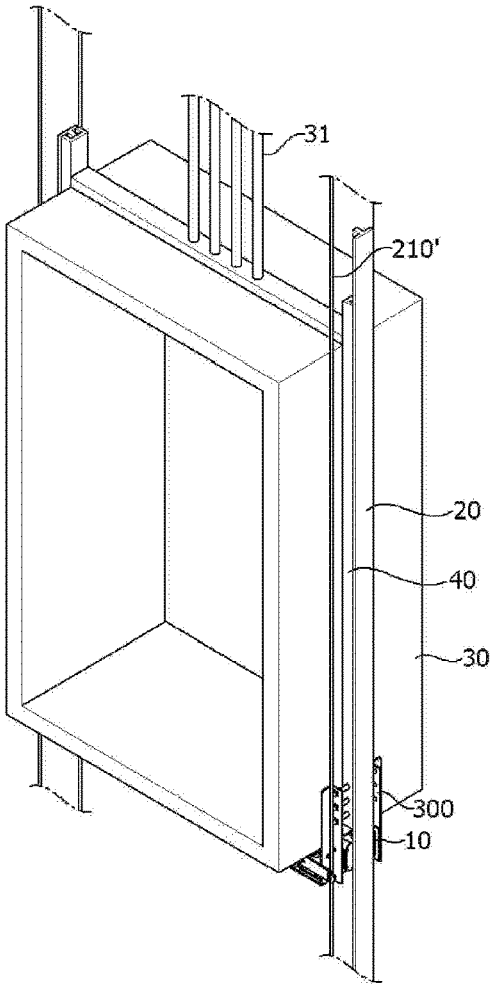
FIG. 5 is a view showing the installed state of the elevator safety device to which the present invention is applied.

The side beam 40 is connected to the connection beams 300 of the elevator safety device 10, which has been assembled through the above-described process, and then, as shown in FIG. 5, the elevator car 30 is seated on the lower beam 100, and at the same time, the side beam 40 is located inside the guide rail 20 such that a portion of the guide rail 20 is located between the first and second pads 223 and 233 of the first and second emergency stop units 220 and 230.

In addition, guide shoes (not shown) are mounted to the lower surface 131*c* of the front support member 130 and the lower surface 141*c* of the rear support member 140 in order to prevent separation from the guide rail 20. The guide shoes (not shown) are secured to the lower surfaces 131*c* and 141*c* by fastening bolts (not shown) to fixing nuts 131*c*' and 141*c*', which are fixed to the lower surfaces 131*c* and 141*c*, in the state in which the guide shoes are in close contact with the lower surfaces 131*c* and 141*c*, and a speed governor rope 210', which is operated by a general speed governor, is mounted through the through-hole 212 in the hinge member 210.

In the state in which the elevator safety device 10 is mounted to the elevator car 30 through the above-described process, the elevator car 30 is moved upwards and downwards by the operation of a main rope 31 under the control of a controller.

When the descending speed of the elevator car 30, which is moved upwards and downwards by the main rope, exceeds a threshold speed, the emergency stop device is operated under the control of the controller so that the speed governor holds the speed governor rope 210', whereby a relative speed is generated between the elevator car 30, which is descending, and the speed governor due to the speed governor rope 210', and accordingly, the speed governor rope 210' is pulled upwards relative to the elevator car 30.

Figure 6:
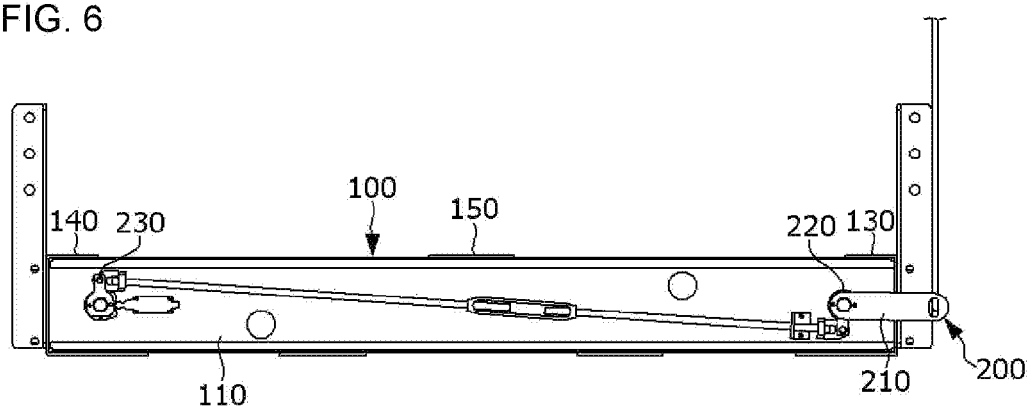
FIGS. 6 to 9 are views showing the operation of the elevator safety device to which the present invention is applied.
Figure 7:
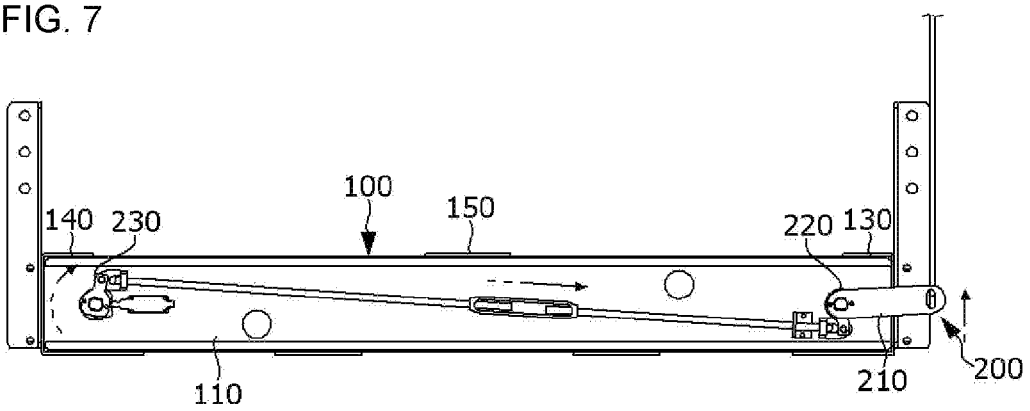
Figure 8:
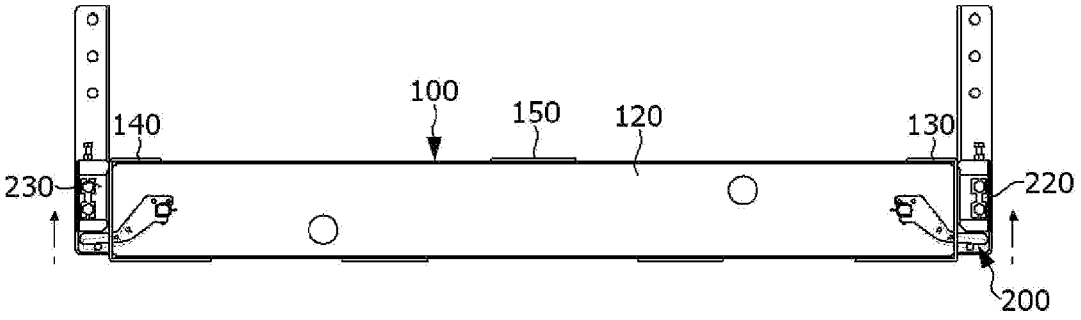

When the speed governor rope 210' is pulled, as shown in FIGS. 6 to 8, the hinge member 210 is rotated upwards about the through-hole 211, and at the same time, the first rotary member 221 of the first emergency stop unit 220, which is fitted in the through-hole 211 in the hinge member 210 in a polygonal-shaped engagement manner, is rotated upwards in conjunction with the rotation of the hinge member 210.

Figure 9:
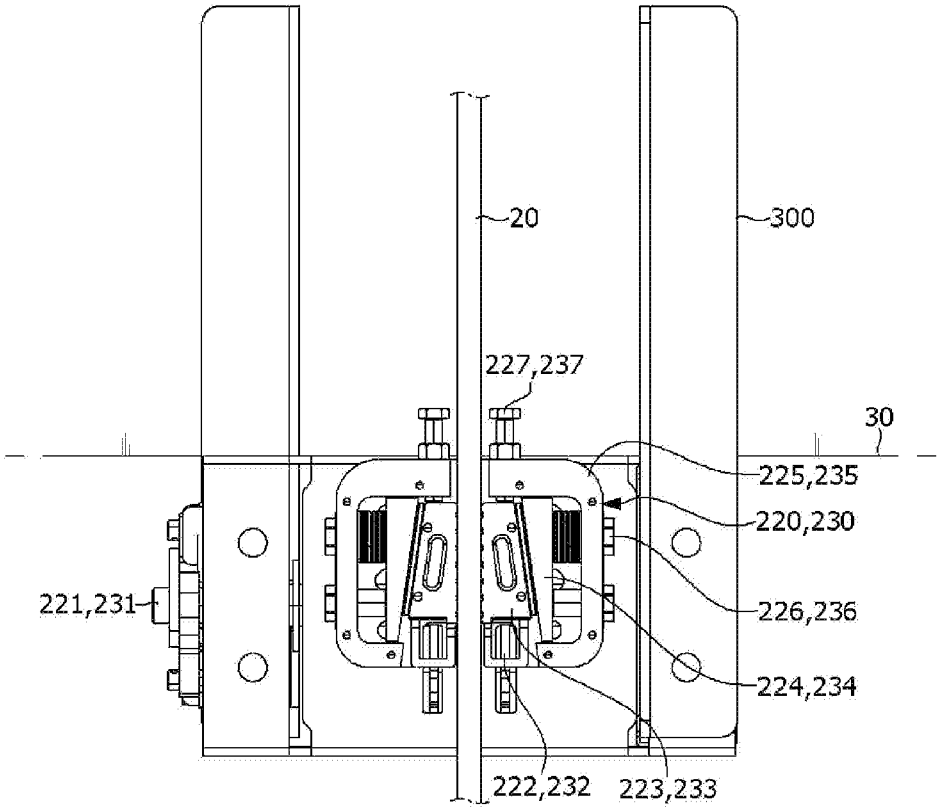

At this time, as shown in FIG. 9, the first rotary piece 222 coupled to the first rotary member 221 rotates upwards and moves the first pad 223 upwards. The first pad 223 moves upwards along the first movement control member 224, and at the same time, moves horizontally along the inclined surface of the first movement control member 224 so as to come into close contact with the guide rail 20, with the result that frictional force is generated between the first pad 223 and the guide rail 20.

Further, the first rotary member 221 of the first emergency stop unit 220 pulls the link member 240, which is connected to the first rotary member 221, while being rotated upwards by the hinge member 210, whereby the second rotary member 231 of the second emergency stop unit 230, which is connected to the link member 240, is rotated upwards.

At this time, the second rotary piece 232, coupled to the second rotary member 231, rotates upwards and moves the second pad 233 upwards. The second pad 233 moves upwards along the second movement control member 234, and at the same time, moves horizontally along the inclined surface of the second movement control member 234 so as to come into close contact with the guide rail 20, with the result that frictional force is generated between the second pad 233 and the guide rail 20.

Since the downward movement of the elevator car 30 is stopped by the frictional force generated between the first and second pads 223 and 233 and the guide rail 20, it is possible to brake the elevator more rapidly and safely.

Although the present invention has been described with reference to limited embodiments thereof and to the drawings, the present invention is not limited to the above embodiments. It is to be understood that various modifications and changes can be made from the above description by those skilled in the art to which the present invention pertains.

Therefore, the scope of the present invention is not limited to the above embodiments, and should be defined by the accompanying claims and equivalents thereof.

DESCRIPTION OF REFERENCE NUMERALS

| | |
|---|---|
| 10: elevator safety device | 20: guide rail |
| 30: elevator car | 100: lower beam |
| 110: first side member | 120: second side member |
| 130: front support member | 140: rear support member |
| 150: connection-reinforcing member | |
| 200: emergency stop device | 210: hinge member |
| 220: first emergency stop unit | |
| 230: second emergency stop unit | 240: link member |

The invention claimed is:

1. An elevator safety device, comprising:

a lower beam; and an emergency stop device mounted parallel to the lower beam in order to perform an emergency stop of an elevator car, wherein the lower beam comprises:

a first side member;

a second side member disposed opposite the first side member;

a front support member configured to be coupled to and to support front portions of the first side member and the second side member; and a rear support member configured to be coupled to and to support rear portions of the first side member and the second side member, wherein the front support member and the rear support member comprise:

bodies formed so as to surround the front and rear portions of the first side member and the second side member;

slits vertically formed through the bodies in order to allow a first front surface of the first side member, a second front surface of the second side member, a first rear surface of the first side member, and a second rear surface of the second side member to be inserted therethrough and to protrude therefrom; and operation holes formed through the bodies in order to guide ascent and descent of a rotary control piece of the emergency stop device, wherein the rotary control piece is inserted through the operation holes, wherein the first and second side members comprise:

first and second vertical surfaces having a rectangular plate shape;

first and second upper surfaces and first and second lower surfaces bent and extending outwards from upper and lower end portions of the first and second vertical surfaces;

first and second front surfaces extending from front portions of the first and second vertical surfaces; and first and second rear surfaces extending from rear portions of the first and second vertical surfaces, wherein the bodies comprise:

vertical surfaces through which the slits and the operation holes are formed;

upper surfaces bent and extending from upper end portions of the vertical surfaces so as to be seated on a first upper surface of the first side member and a second upper surface of the second side member; and lower surfaces bent and extending from lower end portions of the vertical surfaces so as to be seated on a first lower surface of the first side member and a second lower surface of the second side member;

wherein the upper surfaces of the bodies contact with the first and second upper surfaces of the first and the second side member in surface to surface contact, and wherein the lower surfaces of the bodies contact with the first and second lower surfaces of the first and the second side member in surface to surface contact.

2. The elevator safety device according to claim 1, wherein the emergency stop device comprises:

a hinge member;

a first emergency stop unit configured to be rotated upwards in a front region of the first side member and the second side member by rotation of the hinge member in order to cause a first pad to come into close contact with a guide rail so that downward movement of the elevator car is stopped; and a second emergency stop unit configured to be rotated upwards in a rear region of the first side member and the second side member by movement of a link member due to rotation of the hinge member in order to cause a second pad to come into close contact with the guide rail so that downward movement of the elevator car is stopped.

* * * * *